US008550473B2

(12) United States Patent
Miller

(10) Patent No.: US 8,550,473 B2
(45) Date of Patent: Oct. 8, 2013

(54) TRUCK ASSEMBLY

(75) Inventor: Daniel James Miller, Abbotsford (CA)

(73) Assignee: Riedell Shoes, Inc., Red Wing, MN (US)

( * ) Notice: Subject to any disclaimer, the term of this patent is extended or adjusted under 35 U.S.C. 154(b) by 0 days.

(21) Appl. No.: 13/436,359

(22) Filed: Mar. 30, 2012

(65) Prior Publication Data

US 2012/0248718 A1 Oct. 4, 2012

Related U.S. Application Data

(60) Provisional application No. 61/470,088, filed on Mar. 31, 2011.

(51) Int. Cl.
*A63C 1/24* (2006.01)

(52) U.S. Cl.
USPC ..... 280/11.28; 280/11.19; 280/87.042

(58) Field of Classification Search
USPC ..... 280/11.27, 11.28, 87.042, 11.19
See application file for complete search history.

(56) References Cited

U.S. PATENT DOCUMENTS

| | | | | | |
|---|---|---|---|---|---|
| 296,358 | A | * | 4/1884 | Rowlett | 280/11.28 |
| 313,744 | A | * | 3/1885 | Lawless | 280/11.28 |
| 321,337 | A | * | 6/1885 | Becktel | 280/11.28 |
| 322,383 | A | * | 7/1885 | Kitselman | 280/11.26 |
| 322,504 | A | | 7/1885 | Thompson | |
| 324,309 | A | * | 8/1885 | Doty | 280/11.28 |
| 324,376 | A | * | 8/1885 | Hart | 280/11.28 |
| 327,222 | A | * | 9/1885 | Belknap et al. | 280/11.19 |
| 328,070 | A | * | 10/1885 | Rowlett | 280/11.19 |
| 2,051,414 | A | * | 8/1936 | Fritz et al. | 280/11.26 |
| 2,180,062 | A | | 11/1939 | Lee, Jr. et al. | |
| 2,269,080 | A | * | 1/1942 | Coldwell et al. | 280/11.28 |
| 2,275,035 | A | * | 3/1942 | Pardon | 280/11.28 |
| 2,424,819 | A | * | 7/1947 | Guttridge | 280/7.13 |
| 2,653,821 | A | * | 9/1953 | Ware | 280/11.28 |
| 2,719,723 | A | * | 10/1955 | Ware | 280/11.209 |
| 2,719,725 | A | * | 10/1955 | Ware | 280/11.28 |
| 2,726,873 | A | | 12/1955 | Woolley | |
| 2,763,490 | A | | 9/1956 | Crone | |
| 2,920,899 | A | * | 1/1960 | Crone | 280/11.28 |
| 3,104,887 | A | * | 9/1963 | Rice et al. | 280/11.209 |
| 3,738,673 | A | | 6/1973 | Iseman | |
| 3,862,763 | A | * | 1/1975 | Ware | 280/11.28 |
| 4,047,725 | A | | 9/1977 | Pinchock | |
| 4,262,918 | A | * | 4/1981 | Sandino | 280/11.26 |
| 4,398,734 | A | * | 8/1983 | Barnard | 280/11.28 |
| 4,596,396 | A | * | 6/1986 | Merbler | 280/11.28 |

(Continued)

*Primary Examiner* — John Walters
*Assistant Examiner* — James Triggs
(74) *Attorney, Agent, or Firm* — Brooks, Cameron & Huebsch, PLLC

(57) ABSTRACT

A truck assembly having a mounting plate with a first mounting bracket with a first arm, a second arm and a ridge; a cushion with a front surface that defines a concave segment, and a rear surface that defines a notch that receives and seats the ridge; an axle assembly with a truck support having a convex surface that seats in a socket defined by the concave segment and at least a portion of the first arm and the second arm; a swing pin releasably joining the cushion and the axle assembly to the first mounting bracket and adjustment members each having a first surface, a second surface, and a cushion arm. The cushion arm contacts a lateral surface of the cushion, where an adjustment nut attached to the truck support can be used to move the cushion arm of the adjustment member relative the lateral surface of the cushion.

11 Claims, 12 Drawing Sheets

(56) References Cited

U.S. PATENT DOCUMENTS

| | | | | | |
|---|---|---|---|---|---|
| 4,817,974 | A * | 4/1989 | Bergeron | 280/11.209 |
| 5,052,701 | A * | 10/1991 | Olson | 280/11.208 |
| 5,068,956 | A * | 12/1991 | Malewicz | 29/437 |
| 5,263,725 | A * | 11/1993 | Gesmer et al. | 280/11.28 |
| 5,372,383 | A * | 12/1994 | Kubierschky | 280/842 |
| 5,879,013 | A * | 3/1999 | Shih | 280/11.28 |
| 6,082,746 | A * | 7/2000 | Wrike | 280/11.223 |
| 6,120,040 | A * | 9/2000 | Svensson et al. | 280/11.224 |
| 6,467,782 | B1 * | 10/2002 | Smith | 280/87.042 |
| 6,474,666 | B1 * | 11/2002 | Andersen et al. | 280/87.041 |
| 6,523,837 | B2 * | 2/2003 | Kirkland | 280/11.28 |
| 6,679,505 | B2 * | 1/2004 | Yang | 280/11.19 |
| 6,793,224 | B2 * | 9/2004 | Stratton | 280/87.042 |
| 7,007,957 | B1 * | 3/2006 | Lee | 280/11.28 |
| 7,104,558 | B1 * | 9/2006 | Saldana | 280/87.042 |
| 7,232,139 | B2 * | 6/2007 | Cole | 280/87.042 |
| 7,364,174 | B2 * | 4/2008 | Morris | 280/87.042 |
| 7,438,303 | B2 * | 10/2008 | Cole | 280/87.042 |
| 7,735,841 | B1 * | 6/2010 | Longino | 280/11.28 |
| 8,251,377 | B2 * | 8/2012 | Green et al. | 280/11.27 |
| 2003/0197338 | A1 * | 10/2003 | Chen | 280/11.224 |
| 2004/0036243 | A1 * | 2/2004 | Chang | 280/87.042 |
| 2004/0145142 | A1 * | 7/2004 | Wang | 280/87.042 |
| 2008/0246235 | A1 * | 10/2008 | Alexander | 280/11.225 |
| 2010/0295260 | A1 * | 11/2010 | Trew | 280/11.204 |
| 2010/0314851 | A1 * | 12/2010 | Palmer et al. | 280/87.042 |
| 2010/0327547 | A1 * | 12/2010 | Wilson et al. | 280/87.042 |
| 2011/0316245 | A1 * | 12/2011 | Burke | 280/11.27 |

* cited by examiner

TRUCK ASSEMBLY

This application claims the benefit of U.S. Provisional Application No. 61/470,088 filed Mar. 31, 2011, the entire content of which is incorporated herein by reference.

FIELD OF DISCLOSURE

The present disclosure relates generally to a truck assembly, and more particularly to a truck assembly useful with roller skates and/or skate boards.

BACKGROUND

Trucks help a user to turn their roller skates. The skater can turn their roller skates by leaning their weight laterally through their foot thereby causing the cushions of the truck to flex and the axle of the truck and the wheels of the roller skate to tilt to the left or to the right. When the truck is not being used to turn the roller skate the pressure applied on the cushion is uniform. As such, the same amount of force is necessary to tilt the axle of the truck to the left or to the right.

SUMMARY

Embodiments of the present disclosure provide for a truck assembly that provides for, among other things, the ability to independently tune the turning action of the truck assembly, as provided herein.

The truck assembly of the present disclosure includes a mounting plate, a cushion, an axle assembly, a swing pin, a first adjustment member, a second adjustment member, a first adjustment nut and a second adjustment nut. The mounting plate includes a first mounting bracket with a first arm, a second arm and a ridge. The first arm has a first surface defining a first opening through the first arm. The second arm has a second surface defining a second opening in the second arm, where the first opening and the second opening share a rotation axis. The ridge extends parallel with the rotation axis at least partially between the first arm and the second arm.

The cushion having a front surface and a rear surface opposite the front surface. The front surface defines a concave segment. The rear surface defines a notch that receives and seats the ridge of the mounting bracket. Together the concave segment and at least a portion of the first arm and the second arm define a socket.

The axle assembly has a first wheel shaft, a second wheel shaft and a truck support. The first wheel shaft extends along a central axis from the truck support, where the central axis is perpendicular to the rotation axis of the mounting bracket. The second wheel shaft also extends along the central axis from the truck support, but in a direction opposite the first wheel shaft. The truck support includes a third surface that defines an opening through the truck support, a first tubular shaft, a second tubular shaft, a convex surface, and a guide surface. The opening through the truck support is coaxial with the rotation axis of the first mounting bracket. The first tubular shaft is coaxial with the central axis and extends in a direction of the first wheel shaft away from the opening through the truck support. The second tubular shaft is coaxial with the central axis and extends in a direction of the second wheel shaft away from the opening through the truck support. Both the first tubular shaft and the second tubular shaft have a threaded surface. The convex surface has a convex segment that seats in the socket. The guide surface has a predefined shape.

The swing pin that passes through the first opening of the first mounting bracket, the opening through the truck support and at least partially through the second opening of the first mounting bracket, where the swing pin releasably joins the cushion and the axle assembly to the first mounting bracket.

The first adjustment member has a first surface, a second surface, and a cushion arm. The first surface defines an opening mounted at least partially over the first tubular shaft of the truck support. The second surface seats against the guide surface of the truck support, where the predefined shape allows the first adjustment member to travel at least partially over the guide surface of the truck support and prevents the first surface of the first adjustment member from rotating relative the central axis. The cushion arm extends away from the central axis and contacts a first lateral surface of the cushion.

The second adjustment is operated independently from the first adjustment member. The second adjustment member has a first surface, a second surface, and a cushion arm. The first surface defines an opening mounted at least partially over the second tubular shaft of the truck support. The second surface seats against the guide surface of the truck support, where the predefined shape allows the first adjustment member to travel at least partially over the guide surface of the truck support and prevents the first surface of the second adjustment member from rotating relative the central axis. The cushion arm extends away from the central axis and contacts a second lateral surface of the cushion.

The first adjustment nut has a surface defining an internal thread that reversibly engages the threaded surface of the first tubular shaft of the truck support to move the cushion arm of the first adjustment member relative the first lateral surface of the cushion. The second adjustment nut has a surface defining an internal thread that reversibly engages the threaded surface of the second tubular shaft of the truck support to move the cushion arm of the second adjustment member relative the second lateral surface of the cushion.

In an additional embodiment, the truck assembly of the present disclosure can include a mounting plate having both the first mounting bracket, as discussed herein, and a second mounting bracket, where the second mounting bracket on the mounting plate has the same elements as the first mounting bracket. The truck assembly having the first and second mounting bracket also includes cushions, axle assemblies, swing pins, first adjustment members, second adjustment members, first adjustment nuts and second adjustment nuts.

The present disclosure also provides for a roller-skate that includes a boot having a sole, the mounting plate secured to the sole of the boot, where the mounting plate includes the first mounting bracket and the second mounting bracket, as discussed herein, and a wheel mounted on each of the first wheel shaft and the second wheel shaft.

The present disclosure also provides for a cushion for a truck assembly, where the cushion includes a front surface and a rear surface opposite the front surface, where the front surface defines a concave segment and the rear surface defines a notch that receives a ridge of the truck assembly.

DETAILED DESCRIPTION

Figure 1:
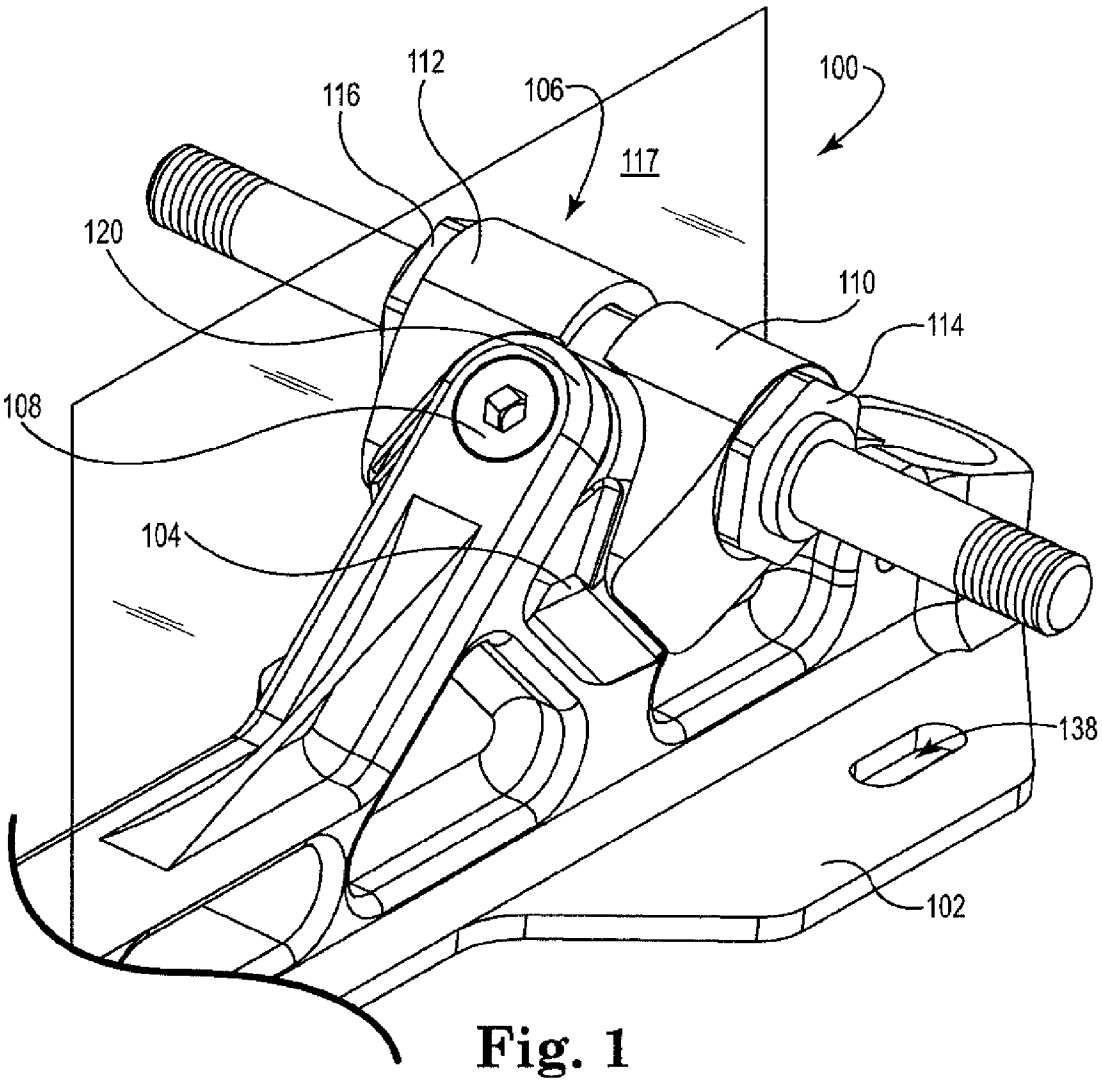
FIG. 1 illustrates a truck assembly according to an embodiment of the present disclosure.

FIG. 1 illustrates an embodiment of a truck assembly 100 according to the present disclosure. The truck assembly 100 includes a mounting plate 102, a cushion 104, an axle assembly 106, a swing pin 108, a first adjustment member 110, a second adjustment member 112, a first adjustment nut 114, and a second adjustment nut 116. As discussed herein, the first adjustment member 110 and the second adjustment member 112 can be independently moved, relative each other, through the use of their respective first adjustment nut 114, and second adjustment nut 116. This allows independent adjustment of the first adjustment member 110 and the second adjustment member 112 relative the cushion 104.

The truck assembly 100 introduces an approach to adjusting the turning action of a truck useful for roller skates and/or skate boards that is very different than traditional approaches. For the present disclosure, pressure applied to the cushion 104 (through the adjustment members 110, 112, as discussed herein) for adjusting the turning action of the truck assembly 100 is directed either into or out of a median plane 117 that bisects the truck assembly 100 vertically through the mounting plate 102, the cushion 104, the axle assembly 106 and the swing pin 108.

The adjustment members 110, 112 can also be used to apply pressure to the cushion 104 independently of each other. This feature of the truck assembly 100 allows for the option of "tuning" the steering of the truck assembly 100 in a directional format. That is to say, it allows the user to put pressure on the cushion 104 in an asymmetrical way form the right side or the left side, relative the medial plane 117, of the truck assembly 100. So, for example, if steering to the left (in a common pattern for a skater to skate in circles or laps around the rink in repetitive left-turn cycle), he/she can adjust the pressure on one side of the cushion 104 completely independently from the other side thus presenting a benefit to the user. This is unique because traditional trucks only offer a single force direction on the cushion (straight down or approximately vertical) and does not allow for compensation for a competitive or recreational user to focus on a single direction turning radius focus.

Figure 2:
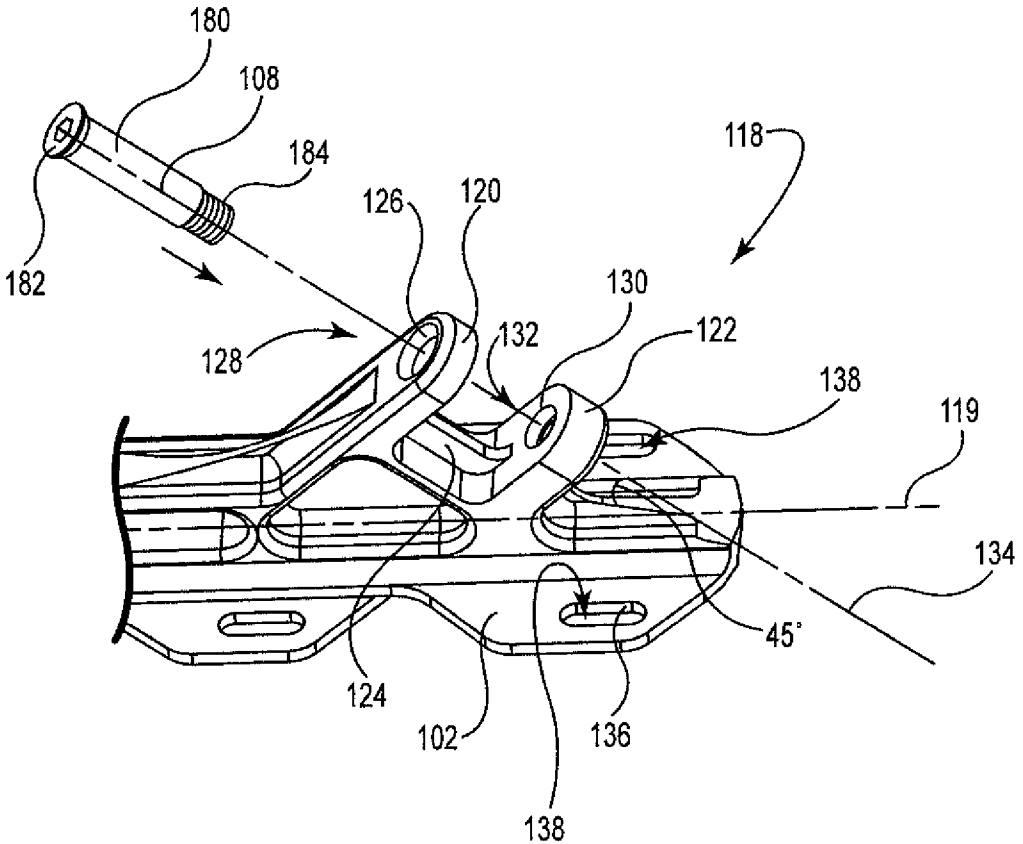
FIG. 2 illustrates a mounting plate and a swing pin of the truck assembly according to an embodiment of the present disclosure.

FIG. 2 illustrates an embodiment of the mounting plate 102. As illustrated, the mounting plate 102 includes a first mounting bracket 118 with a first arm 120, a second arm 122 and a ridge 124. The first arm 120 and the second arm 122 extend parallel to each other from the mounting plate 102. The first arm 120 has a first surface 126 defining a first opening 128 through the first arm 120. The second arm 122 has a second surface 130 defining a second opening 132 in the second arm 122.

The first opening 128 and the second opening 132 share a rotation axis 134. As illustrated, the rotational axis 134 is located in the approximate center of the openings 128 and 132 defined by the first surface 126 and second surface 130, respectively. Relative a longitudinal axis 119 of the mounting plate 102, the rotation axis 134 forms an angle of about forty-five (45) degrees (as illustrated). It is appreciated that other angles for the rotation axis 134 relative the longitudinal axis 119 of the mounting plate 102 are also possible. These can include, but are not limited to, 10 degrees.

As illustrated, the ridge 124 extends parallel with the rotation axis 134 at least partially between the first arm 120 and the second arm 122. In one embodiment, the ridge 124 can extend completely between the first arm 120 and the second arm 122. In addition, the ridge 124 can extend up to approximately the first surface 126 and/or the second surface 130. For the various embodiments, the ridge 124 can have different heights and/or thicknesses as desired. .

The mounting plate 102 further includes surfaces 136 that define mounting openings 138 through the mounting plate 102. A fastener can pass at least partially through the mounting opening 138 to allow the mounting plate 102 to be secured to a boot of a roller skate or to a board of a skateboard. Such fasteners can include, but are not limited to, a screw or a threaded bolt, where a threaded nut can be used with the threaded bolt to secure the mounting plate 102.

Figure 3A:
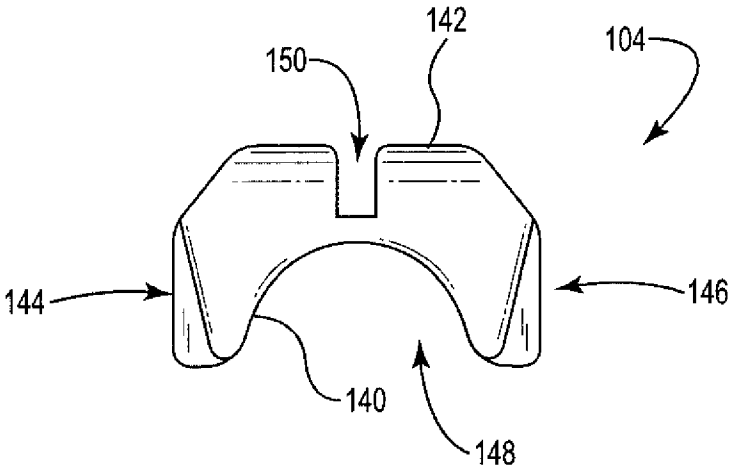
FIG. 3A illustrates a cushion of the truck assembly according to an embodiment of the present disclosure.

FIG. 3A illustrates an embodiment of the cushion 104. As illustrated, the cushion 104 includes a front surface 140 and a rear surface 142 opposite the front surface 140. The cushion 104 also includes a first lateral surface 144 and a second lateral surface 146 that engage the first adjustment member 110 and the second adjustment member 112, as discussed herein. As illustrated, the front surface 140 defines a concave segment 148 and the rear surface 142 defines a notch 150. The notch 150 can receive and seat the ridge 124 of the first mounting bracket 118. For the various embodiments, the cushion 104 can be formed of a polymer. Examples of suitable polymers include, but are not limited to natural rubber, synthetic rubber or polyurethane. For the various embodiments, the cushion 104 can be formed in a molding process, such as injection molding or compression molding, among others. In one embodiment, the notch 150 is 0.1 inch wide and 0.806 inch long. Other sizes for the width and length of the notch 150 are possible.

For the embodiments, when the ridge 124 is seated in the notch 150, pressure applied to one of the first lateral surface 144 or the second lateral surface 146 of the cushion 104 can be carried by the ridge 124. In this way, the amount of pressure transferred through the cushion 104 from one of the first lateral surface 144 to the second lateral surface 146, or visa-versa, can be minimized. As appreciated, the ridge 124 has a height, a length and a thickness that, for the given material from which it is produced, can carry this pressure and/or force as the truck assembly 100 is used.

Figure 3B:
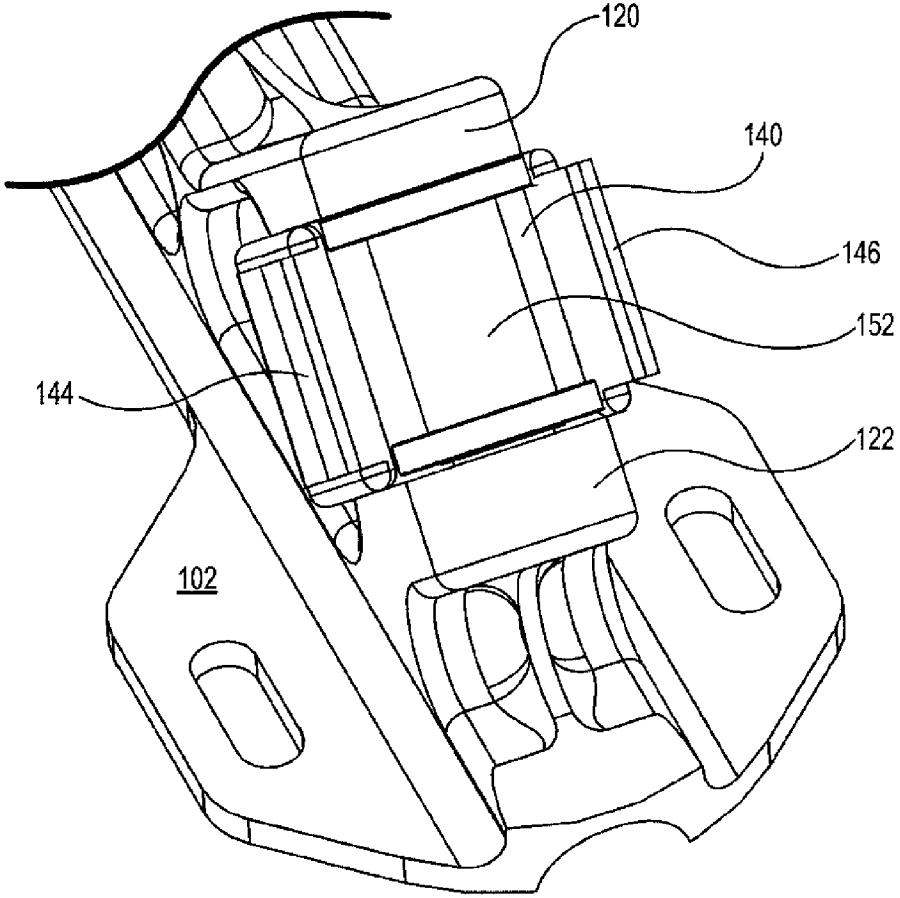
FIG. 3B illustrates the cushion of the truck assembly seated in the mounting plate according to an embodiment of the present disclosure.

FIG. 3B illustrates the cushion 104 positioned between the first arm 120 and the second arm 122 of the first mounting bracket 118 with the ridge seated in the notch. As illustrated, together the concave segment 148 of the cushion 104 and at least a portion of the first arm 120 and the second arm 122 define a socket 152.

Figure 4A:
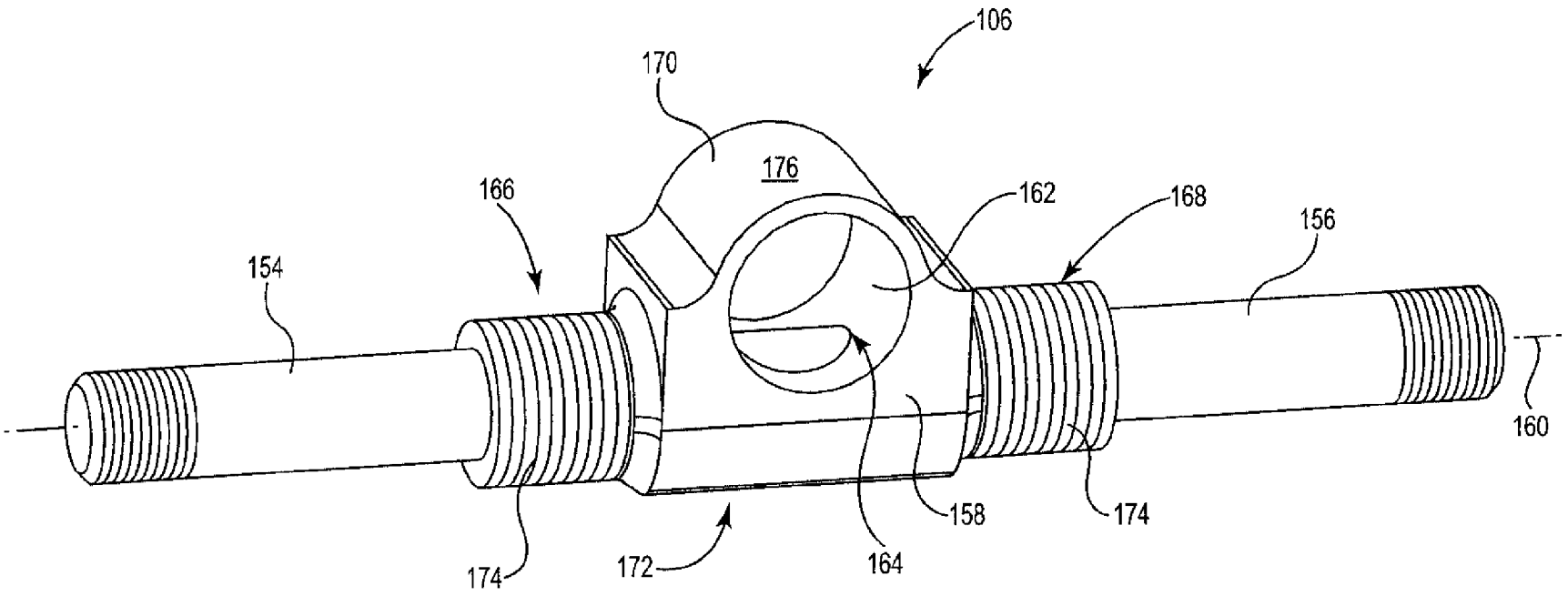
FIG. 4A illustrates an axle assembly of the truck assembly according to an embodiment of the present disclosure.

FIG. 4A provides an illustration of the axle assembly 106. As illustrated, the axle assembly 106 includes a first wheel shaft 154, a second wheel shaft 156 and a truck support 158. The first wheel shaft 154 extends along a central axis 160 from the truck support 158, while the second wheel shaft 156 extends along the central axis 160 from the truck support 158 in a direction opposite the first wheel shaft 154.

The truck support 158 also includes a third surface 162 that defines an opening 164 through the truck support 158, a first tubular shaft 166, a second tubular shaft 168, a convex surface 168, and a guide surface 172 having a predefined shape. When assembled (as illustrated in FIG. 1 for example), the opening 164 through the truck support 158 is coaxial with the rotation axis 134 of the first mounting bracket 118.

The first tubular shaft 166 is coaxial with the central axis 160 and extends in a direction of the first wheel shaft 154 away from the opening 164 through the truck support 158. The second tubular shaft 168 is also coaxial with the central axis 160 and extends in a direction of the second wheel shaft 156 away from the opening 164 through the truck support 158. Both the first tubular shaft 166 and the second tubular shaft 168 have a threaded surface 174 that can receive the first adjustment nut and the second adjustment nut, respectively.

Figure 4B:
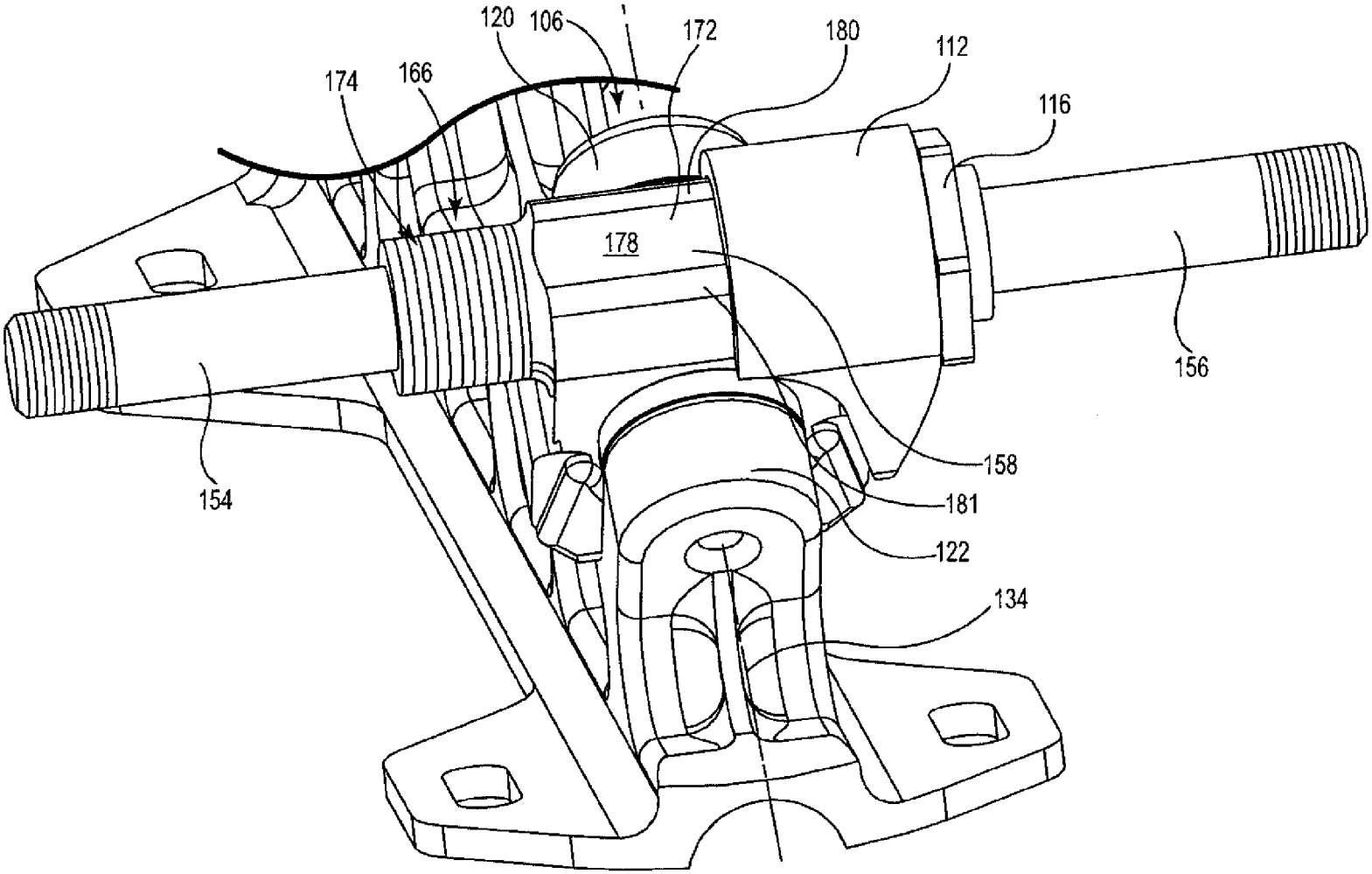
FIG. 4B illustrates the axle assembly positioned relative the cushion and mounting plate of the truck assembly according to an embodiment of the present disclosure.

The convex surface 168 has a convex segment 176 that seats in the socket 152. FIG. 4B provides an illustration in which the convex segment is seated in the socket. FIG. 4B also provides a view of the guide surface 172 of the truck support 158, where the guide surface 172 has a predefined shape. As illustrated in the embodiment of FIG. 4B, the predefined shape of the guide surface 172 has a planar surface 178 with a first shoulder 180 and a second shoulder 181 (e.g., an angled or sloping surface relative the planar surface 176). As discussed more fully herein, the predefined shape of the guide surface 170 allows for the first adjustment member 110 and the second adjustment member 112 to each independently travel laterally (relative the central axis 160) over at least a portion of the guide surface 170 without rotating relative the central axis 160. It is appreciated that other predefined shapes for the guide surface 172 are possible (e.g., other shapes that would allow the first adjustment member 110 and the second adjustment member 112 to each independently travel laterally (relative the central axis 160) over at least a portion of the guide surface 170 without rotating relative the central axis 160).

FIG. 4B, as discussed herein, illustrates the axle assembly 106 positioned so that the convex segment is seated in the socket (as seen in FIG. 3B) with the rotation axis 134 passing through the geometric centers of the first opening 128, the second opening 132 and the opening 164 through the truck support 158 (e.g., coaxial). As illustrated in FIGS. 1 and 2, the swing pin 108 passes through the first opening 128 of the first mounting bracket 118, the opening 164 through the truck support 158 and at least partially through the second opening 132 of the first mounting bracket 118. In this way, the swing pin 108 can releasably join the cushion 104 and the axle assembly 106 to the first mounting bracket 118. As illustrated in FIG. 2, the swing pin 108 can be in the form of a threaded bolt having a shaft 180 with a head 182 having a socket (e.g., a hexagonal socket) to receive a driving tool (e.g., a hex key) at one end of the shaft 180 and a surface defining thread 184 at the other end of the shaft 180. The second surface 130 defining the second opening 132 can include a thread tapped into the surface 130 that allow for thread 184 of the swing pin 108 to be releasably joined to the first mounting bracket 118.

Figure 5:
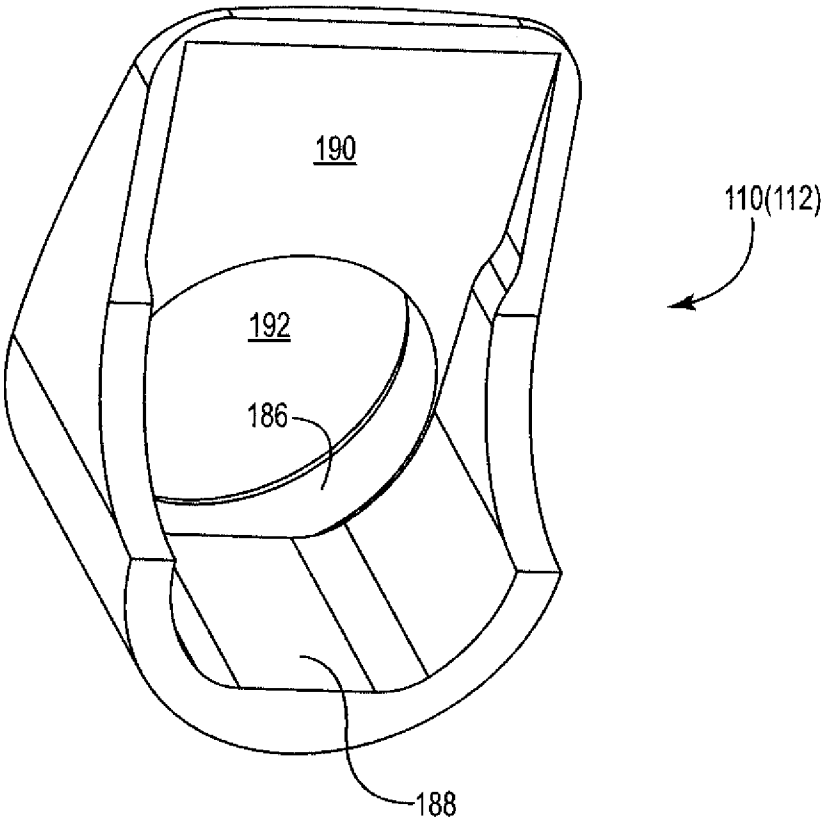
FIG. 5 illustrates an adjustment member according to an embodiment of the present disclosure.

FIG. 4B also illustrates an embodiment of the second adjustment member 112 positioned on the axle assembly 106, where the first adjustment member (110) is not shown so as to illustrate the thread 174. FIG. 5 illustrates an embodiment of the adjustment member 110, 112 where the description of the adjustment member is applicable to both the first and the second adjustment members 110, 112. As illustrated, the adjustment member 110, 112 has a first surface 186, a second surface 188, and a cushion arm 190. The first surface 186 defines an opening 192 that can be mounted at least partially over the first tubular shaft 166 or the second tubular shaft 168 of the truck support 158. The second surface 188 seats against the guide surface 172 of the truck support 158, where the predefined shape, as discussed herein, allows the adjustment member 110, 112 to travel at least partially over the guide surface 172 of the truck support 158 and prevents the first surface 186 of the adjustment member 110, 112 from rotating relative the central axis 160. The cushion arm 190 extends away from both the first surface 186, the second surface 188. When mounted on the truck support 158, the cushion arm 190 of the adjustment member 110, 112 also extends away from the central axis 160 of the truck support 158 and can contact the first lateral surface 144 and the second lateral surface 146, respectively, of the cushion 104.

Identical to the first adjustment member 110, the second adjustment member 112 also has the first surface 186, the second surface 188, and the cushion arm 190 (the second adjustment member 112 shown in FIG. 5, where element number 112 for the second adjustment member is shown in parentheses). The second adjustment member 112 includes the first surface 186 defining the opening 192 that can be mounted at least partially over the second tubular shaft 168 of the truck support 158. The second surface 188 seats against the guide surface 172 of the truck support 158, where the predefined shape, as discussed herein, allows the second adjustment member 112 to travel at least partially over the guide surface 172 of the truck support 158 and prevents the first surface 186 of the second adjustment member 112 from rotating relative the central axis 160. The cushion arm 190 extends away from both the first surface 186, the second surface 188. When mounted on the truck support 158, the cushion arm 190 of the first adjustment member 110 also extends away from the central axis 160 of the truck support 158 and can contact the second lateral surface 146 of the cushion 104.

Figure 6:
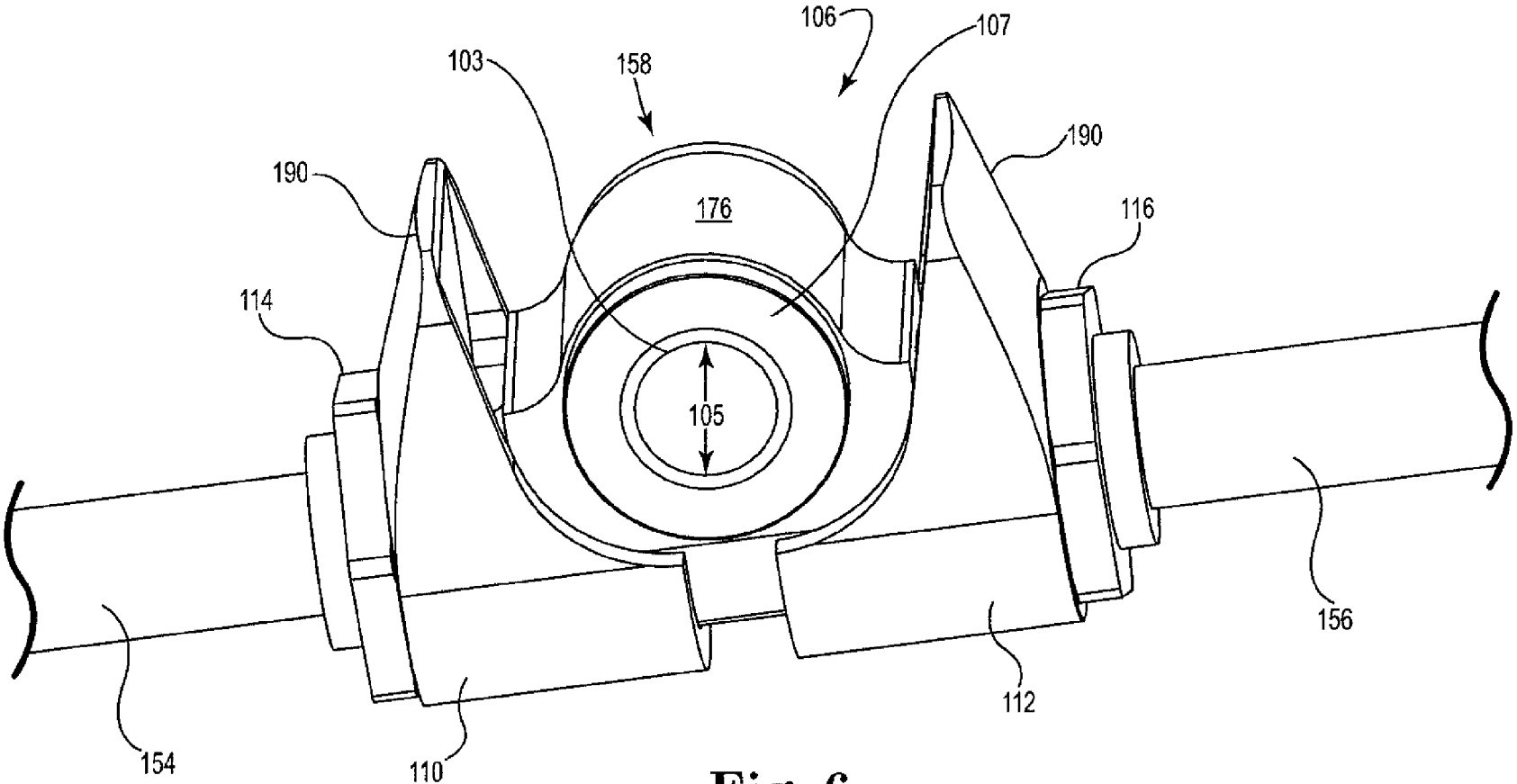
FIG. 6 illustrates the axle assembly, the first adjustment member and the second adjustment member according to an embodiment of the present disclosure.
Figure 7:
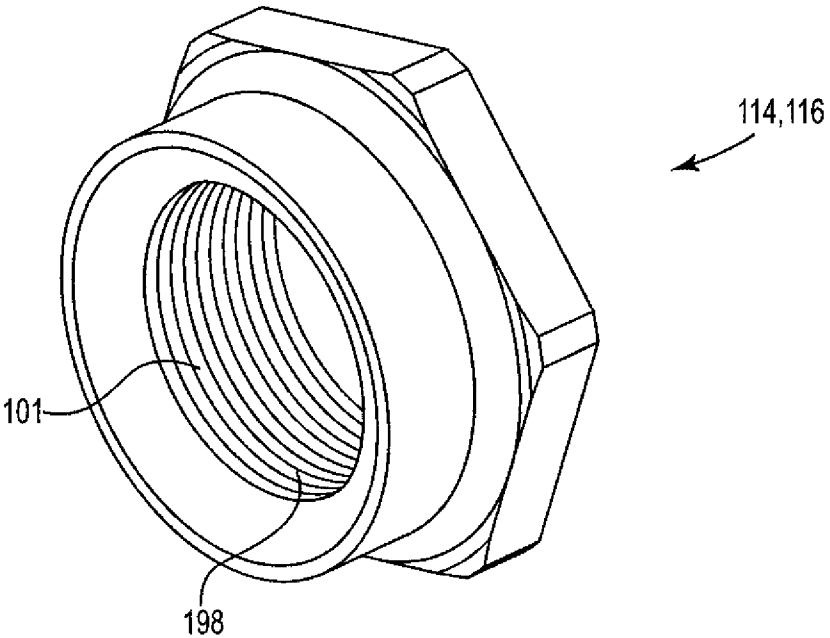
FIG. 7 illustrates an adjustment nut according to an embodiment of the present disclosure.

FIG. 6 provides an illustration of the axle assembly 106, the first adjustment member 110 and the second adjustment member 112, as discussed herein. FIG. 6 also illustrates the first adjustment nut 114 and the second adjustment nut 116, where FIG. 7 illustrates the adjustment nut (e.g., either the first adjustment nut 114 or the second adjustment nut 116) by itself. As seen in FIG. 7, the adjustment nut 114, 116 has a surface 198 defining an internal thread 101 that reversibly engages the threaded surface 174 of either the first tubular shaft 166 and/or the second tubular shaft 168 of the truck support 158. As the adjustment nut 114, 116 is rotated relative the threaded surface 174 of the first tubular shaft 166 or the second tubular shaft 168, the cushion arm 190 of the adjustment member 110, 112 can move relative the first lateral surface 144 and/or the second lateral surface 146 of the cushion 104.

Independent of the first adjustment nut 114, the internal tread of the second adjustment nut 116 can reversibly engages the threaded surface 174 of the second tubular shaft 168 of the truck support 158 to move the cushion arm 190 of the second adjustment member 112 relative the second lateral surface 146 of the cushion 104. In other words, the second adjustment nut 116 can be rotated to move the cushion arm 190 of the second adjustment member 112 relative the second lateral surface 146 of the cushion 104 independently of the cushion arm 190 of the first adjustment member 110, and visa-versa.

FIG. 6 also illustrates a bearing 103 seated in the opening of the truck support 158. When assembled (as illustrated in FIG. 1 for example), the bearing 103 is coaxial with the rotation axis 134 of the first mounting bracket 118. The bearing 103 also includes an inner diameter 105 that can allow the shaft 180 of the swing pin 108 to pass through the bearing 103.

The bearing 103 can guide the motion of the axle assembly 106 on the swing pin 108 (having been releasably secured to the first mounting bracket 118 as illustrated in FIG. 1). Specifically, the bearing 103 allows the axle assembly 106 to rotate around at least a portion of the rotation axis 134, where the interaction of the first and second adjustment members 110, 112 and the cushion 104 constrain the amount of rotation.

For the various embodiments, the bearing 103 can be a plain bearing or a roller element bearing. Examples of a plain bearing can include a journal bearing, an integral bearing, or a bushing. Examples of a roller element bearing can include a ball bearing, a cylindrical roller bearing or a needle bearing, among others.

The truck assembly 100 can also include a washer 107 positioned between the truck support 158 and the first arm 120 and/or the second arm 122 of the first mounting bracket 118. An example of a suitable washer 107 includes, but is not limited to, a plain washer. The washer 107 can be formed from a polymer, a metal and/or a metal alloy. Examples of suitable polymers include, but are not limited a nylon (i.e., a polyamide) and polytetrafluoroethylene (PTFE), among others. Examples of suitable metals and/or metal alloys include steel, stainless steel, hardened steel aluminum and titanium, among others.

The truck assembly 100 can be used with a variety of devices. Examples of such devices include, but are not limited to, roller skates and skateboards, among others. The truck assembly 100 can be mounted to the roller skate or skateboard with fasteners (e.g., bolts or screws) that pass through the mounting openings 138 of the mounting plate 102. When bolts (seen in FIG. 4B) are used as the fastener, a nut and washer can be used to secure the truck assembly 100 to the device (e.g., roller skate and/or skateboard).

Figure 8:
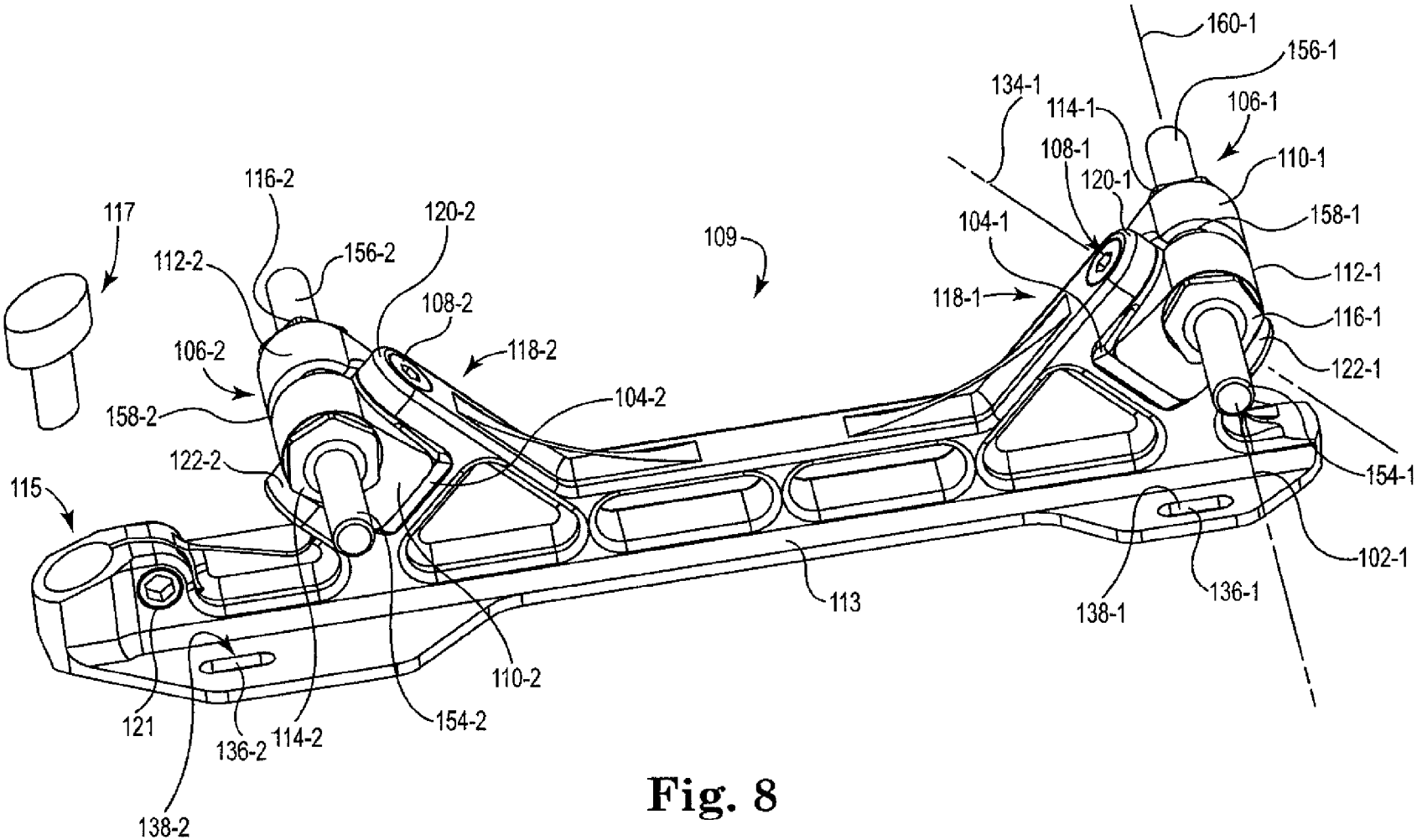
FIG. 8 illustrates an embodiment of a truck assembly according to an embodiment of the present disclosure.
Figure 9:
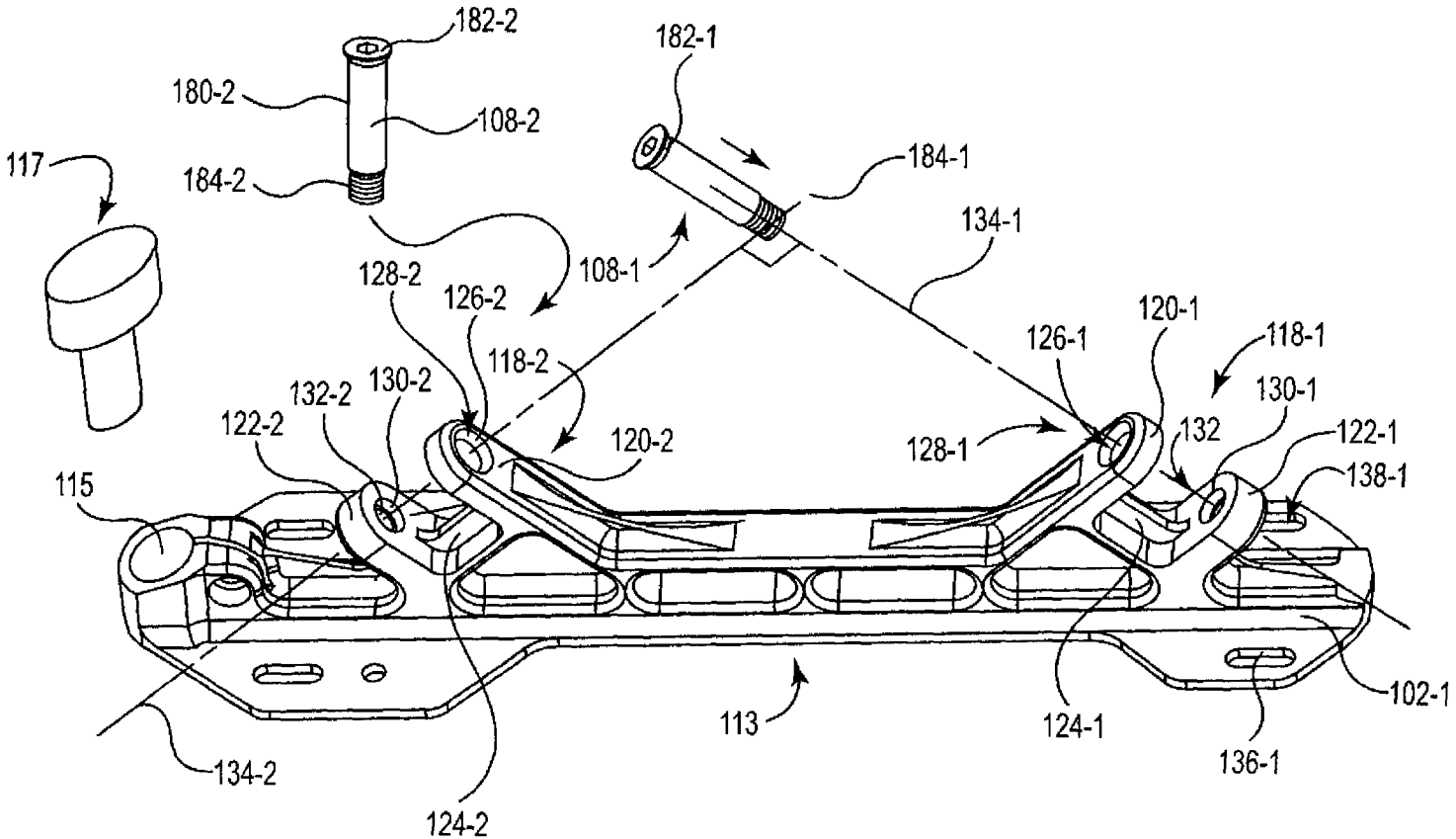
FIG. 9 illustrates a mounting plate of the truck assembly according to an embodiment of the present disclosure.

Referring now to FIG. 8, there is illustrated an additional embodiment of a truck assembly 109 of the present disclosure. The truck assembly 109 includes the first mounting bracket 118-1, as discussed herein, and a second mounting bracket 118-2 on the mounting plate 113. As with the first mounting bracket 118-1, the second mounting bracket 118-2 includes the same structures, such as a first arm 120-2, a second arm 122-2 and a ridge 124-2 (seen in FIG. 9), as discussed herein. As illustrated in FIG. 9, the second mounting bracket 118-2 includes a first surface 126-2 defining a first opening 128-2 through the first arm 120-2, and a second surface 130-2 defining a second opening 132-2 in the second arm 122-2. The first opening 128-2 and the second opening 132-2 of the second mounting bracket 118-2 share a rotation axis 134-2. The ridge 124-2 extends parallel with the rotation axis 134-2 at least partially between the first arm 120-2 and the second arm 122-2. The rotation axis 134-1 of the first mounting bracket 118-1 and the rotation axis 134-2 of the second mounting bracket 118-2 can intersect at an angle of approximately ninety degrees.

The truck assembly 109 further includes cushions 104-1 and 104-2, as discussed herein. As discussed, the notch of the cushions 104-1 and 104-2 can receive and seat each of the ridges 124-1 and 124-2, respectively, of the mounting brackets 118-1 and 118-2, and together the concave segments and at least a portion of the first arms 120-1 and 120-2 and the second arms 122-1 and 122-2 define each respective socket.

The truck assembly 109 also includes axle assemblies 106-1 and 106-2, as discussed herein, each having the first wheel shaft 154-1, 154-2, the second wheel shaft 156-1 and 156-2 and the truck support 158-1, 158-2. As with the truck support 158-1, there is a surface defining an opening through the truck support 158-2 that is coaxial with the rotation axis 134-2 of the second mounting bracket 118-2.

The truck assembly 109 further includes swing pins 108-1 and 108-2. Each of the swing pins 108-1 and 108-2 passes through their respective the first openings 128-1, 128-2, the opening through their respective truck support 158-1, 158-2 and at least partially through each of their respective second opening 132-1, 132-2 to releasably join the cushion 104-1, 104-2 and the axle assemblies 106-1 and 106-2 to the first mounting bracket 118-1 and the second mounting bracket, respectively. The truck assembly 109 further includes first adjustment members 110-1, 110-2, second adjustment members 112-1, 112-2, first adjustment nuts 114-1, 114-2, and second adjustment nuts 116-1, 116-2, as discussed herein.

The truck assembly 109 also includes a socket 115 that can receive a toe stop 117 and hold the toe stop 117 through the use of a set bolt 121, where the set bolt 121 reversibly clamps the toe stop 117 to the truck assembly 109. The truck assembly 109 further includes surfaces 136-1 and 136-2 that define mounting openings 138-1 and 138-2 through the mounting plate 113. Fasteners, as discussed herein, can pass at least partially through the mounting openings 138-1 and 138-2 to allow the mounting plate 113 to be secured to a boot of a roller skate.

Figure 10:
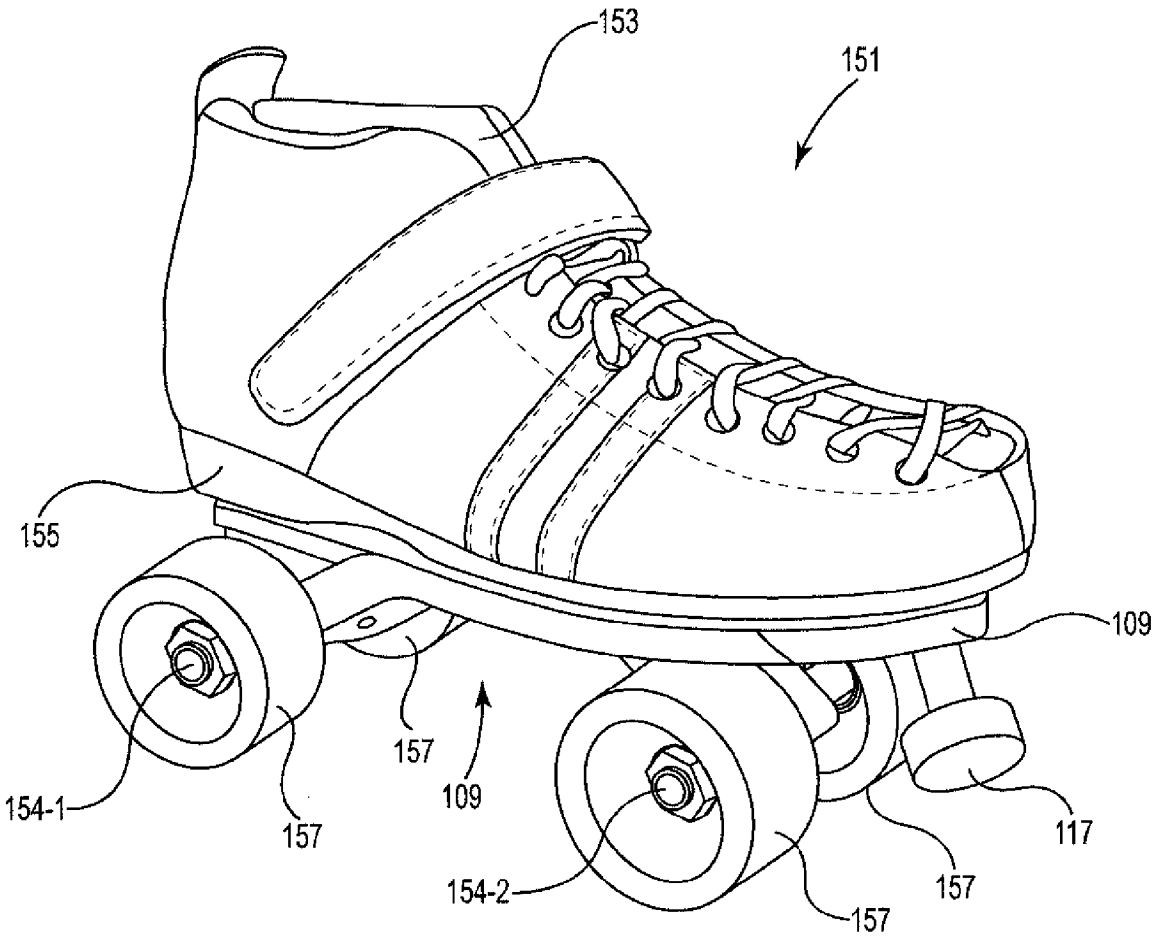
FIG. 10 illustrates a roller skate that includes the truck assembly according to an embodiment of the present disclosure.

FIG. 10 provides an illustration of a roller-skate 151 that includes a boot 153 having a sole 155, and the mounting plate 113 of the truck assembly 109 secured to the sole 155 of the boot 153. As illustrated, a wheel 157 can be mounted on each of the first wheel shaft and the second wheel shaft.

The truck assembly of the present disclosure can be formed from a number of different materials. Examples of such materials include, but are not limited to metals, metal alloys, and combinations thereof. Examples of metals include, but are not limited to, aluminum and titanium, among others. Examples of metal alloys include, but are not limited to, steel (e.g., stainless steel), alloys of aluminum such as 7075 aluminum (among others), and alloys of titanium. Many of the components of the truck assembly of the present disclosure can be machined using a computer numerical control (CNC) machine tool, which can be controlled by computer-aided design (CAD) and/or computer-aided manufacturing (CAM) programs.

It is to be understood that the above description has been made in an illustrative fashion and not a restrictive one. Although specific examples for devices and methods have been illustrated and described herein, other equivalent component arrangements and/or structures conducive to the truck assembly can be substituted for the specific examples shown herein. For example, an axel assembly according to an embodiment of the present disclosure can be configured in such a way that the "adjustment members" as discussed herein are non-adjustable (e.g., fixed). In one embodiment, the truck support and the cushion arms of the axel assembly can be machined from a single piece of material (e.g. metal alloy). A shaft can then be inserted through an opening in the truck support/cushion arm structure to provide the wheel shafts discussed herein.

What is claimed is:

1. A truck assembly, comprising:

a mounting plate having a first mounting bracket with a first arm, a second arm and a ridge, where the first arm has a first surface defining a first opening through the first arm, the second arm has a second surface defining a second opening in the second arm, where the first opening and the second opening share a rotation axis, and the ridge extends parallel with the rotation axis at least partially between the first arm and the second arm;

a cushion having a front surface and a rear surface opposite the front surface, where the front surface defines a concave segment, and the rear surface defines a notch that receives and seats the ridge of the first mounting bracket, and together the concave segment and at least a portion of the first arm and the second arm define a socket;

an axle assembly having a first wheel shaft, a second wheel shaft and a truck support, where, the first wheel shaft extends along a central axis from the truck support, where the central axis is perpendicular to the rotation axis of the first mounting bracket;

the second wheel shaft extends along the central axis from the truck support in a direction opposite the first wheel shaft; and the truck support includes a third surface that defines an opening through the truck support, a first tubular shaft, a second tubular shaft, a convex surface, and a guide surface, where the opening through the truck support is coaxial with the rotation axis of the first mounting bracket, the first tubular shaft is coaxial with the central axis and extends in a direction of the first wheel shaft away from the opening through the truck support, the second tubular shaft is coaxial with the central axis and extends in a direction of the second wheel shaft away from the opening through the truck support, where both the first tubular shaft and the second tubular shaft have a threaded surface, the convex surface has a convex segment that seats in the socket, and the guide surface has a predefined shape;

a swing pin that passes through the first opening of the first mounting bracket, the opening through the truck support and at least partially through the second opening of the first mounting bracket, where the swing pin releasably joins the cushion and the axle assembly to the first mounting bracket;

a first adjustment member having a first surface, a second surface, and a cushion arm, where, the first surface of the first adjustment member defines an opening mounted at least partially over the first tubular shaft of the truck support, the second surface of the first adjustment member seats against the guide surface of the truck support, where the predefined shape allows the first adjustment member to travel at least partially over the guide surface of the truck support and prevents the first surface of the first adjustment member from rotating relative the central axis, and the cushion arm extends away from the central axis and contacts a first lateral surface of the cushion;

a second adjustment member having a first surface, a second surface, and a cushion arm, where, the first surface of the second adjustment member defines an opening mounted at least partially over the second tubular shaft of the truck support, the second surface of the second adjustment member seats against the guide surface of the truck support, where the predefined shape allows the second adjustment member to travel at least partially over the guide surface of the truck support and prevents the first surface of the second adjustment member from rotating relative the central axis, and the cushion arm extends away from the central axis and contacts a second lateral surface of the cushion;

a first adjustment nut having a surface defining an internal thread that reversibly engages the threaded surface of the first tubular shaft of the truck support to move the cushion arm of the first adjustment member relative the first lateral surface of the cushion; and a second adjustment nut having a surface defining an internal thread that reversibly engages the threaded surface of the second tubular shaft of the truck support to move the cushion arm of the second adjustment member relative the second lateral surface of the cushion.

2. The truck assembly of claim 1, where the second adjustment nut moves the cushion arm of the second adjustment member relative the second lateral surface of the cushion independently of the cushion arm of the first adjustment member.

3. The truck assembly of claim 1, where the swing pin includes a surface defining threads and the second surface of the second arm includes threads that reversibly engage the threads of the swing pin.

4. The truck assembly of claim 1, where the ridge of the first mounting bracket extends from the first surface of the first arm to the second surface of the second arm.

5. The truck assembly of claim 1, including a roller element bearing seated in the opening of the truck support, where the roller element bearing is coaxial with the rotation axis of the first mounting bracket.

6. The truck assembly of claim 1, where the mounting plate includes a longitudinal axis, and where the first arm of the first mounting bracket extends away from the mounting plate at a forty-five degree angle relative the longitudinal axis.

7. The truck assembly of claim 1, including a second mounting bracket on the mounting plate, where the second mounting bracket includes a first arm, a second arm and a ridge, where the first arm of the second mounting bracket has a first surface defining a first opening through the first arm, the second arm of the second mounting bracket has a second surface defining a second opening in the second arm, where the first opening and the second opening share a rotation axis, and the ridge extends parallel with the rotation axis at least partially between the first arm and the second arm;

a cushion having a front surface and a rear surface opposite the front surface, where the front surface defines a concave segment, and the rear surface defines a notch that receives and seats the ridge of the second mounting bracket, and together the concave segment and at least a portion of the first arm and the second arm define a socket;

an axle assembly having a first wheel shaft, a second wheel shaft and a truck support, where, the first wheel shaft extends along a central axis from the truck support, where the central axis is perpendicular to the rotation axis of the second mounting bracket;

the second wheel shaft extends along the central axis from the truck support in a direction opposite the first wheel shaft; and the truck support includes a third surface that defines an opening through the truck support, a first tubular shaft, a second tubular shaft, a convex surface, and a guide surface, where the opening through the truck support is coaxial with the rotation axis of the second mounting bracket, the first tubular shaft is coaxial with the central axis and extends in a direction of the first wheel shaft away from the opening through the truck support, the second tubular shaft is coaxial with the central axis and extends in a direction of the second wheel shaft away from the opening through the truck support, where both the first tubular shaft and the second tubular shaft have a threaded surface, the convex surface has a convex segment that seats in the socket, and the guide surface has a predefined shape;

a swing pin that passes through the first opening of the second mounting bracket, the opening through the truck support and at least partially through the second opening of the second mounting bracket, where the swing pin releasably joins the cushion and the axle assembly to the second mounting bracket;

a first adjustment member having a first surface, a second surface, and a cushion arm, where, the first surface of the first adjustment member defines an opening mounted at least partially over the first tubular shaft of the truck support, the second surface of the first adjustment member seats against the guide surface of the truck support, where the predefined shape allows the first adjustment member to travel at least partially over the guide surface of the truck support and prevents the first surface of the first adjustment member from rotating relative the central axis, and the cushion arm extends away from the central axis and contacts a first lateral surface of the cushion;

a second adjustment member having a first surface, a second surface, and a cushion arm, where, the first surface of the second adjustment member defines an opening mounted at least partially over the second tubular shaft of the truck support, the second surface of the second adjustment member seats against the guide surface of the truck support, where the predefined shape allows the second adjustment member to travel at least partially over the guide surface of the truck support and prevents the first surface of the second adjustment member from rotating relative the central axis, and the cushion arm extends away from the central axis and contacts a second lateral surface of the cushion;

a first adjustment nut having a surface defining an internal thread that reversibly engages the threaded surface of the first tubular shaft of the truck support to move the cushion arm of the first adjustment member relative the first lateral surface of the cushion; and a second adjustment nut having a surface defining an internal thread that reversibly engages the threaded surface of the second tubular shaft of the truck support to move the cushion arm of the second adjustment member relative the second lateral surface of the cushion.

8. The truck assembly of claim 7, where the rotation axis of the first mounting bracket and the rotation axis of the second mounting bracket intersect at an angle of approximately ninety degrees.

9. A roller-skate, comprising:

a boot having a sole, a mounting plate secured to the sole of the boot, where the mounting plate includes a first mounting bracket and a second mounting bracket, each mounting bracket having a first arm, a second arm and a ridge, where the first arm has a first surface defining a first opening through the first arm, the second arm has a second surface defining a second opening in the second arm, where the first opening and the second opening share a rotation axis, and the ridge extends parallel with the rotation axis at least partially between the first arm and the second arm;

a cushion having a front surface and a rear surface opposite the front surface, where the front surface defines a concave segment, and the rear surface defines a notch that receives and seats the ridge of the mounting bracket, and together the concave segment and at least a portion of the first arm and the second arm define a socket;

an axle assembly having a first wheel shaft, a second wheel shaft and a truck support, where, the first wheel shaft extends along a central axis from the truck support, where the central axis is perpendicular to the rotation axis of the mounting bracket;

the second wheel shaft extends along the central axis from the truck support in a direction opposite the first wheel shaft; and the truck support includes a third surface that defines an opening through the truck support, a first tubular shaft, a second tubular shaft, a convex surface, and a guide surface, where the opening through the truck support is coaxial with the rotation axis of the mounting bracket, the first tubular shaft is coaxial with the central axis and extends in a direction of the first wheel shaft away from the opening through the truck support, the second tubular shaft is coaxial with the central axis and extends in a direction of the second wheel shaft away from the opening through the truck support, where both the first tubular shaft and the second tubular shaft have a threaded surface, the convex surface has a convex segment that seats in the socket, and the guide surface has a predefined shape;

a swing pin that passes through the first opening of the mounting bracket, the opening through the truck support and at least partially through the second opening of the mounting bracket, where the swing pin releasably joins the cushion and the axle assembly to the mounting bracket;

a first adjustment member having a first surface, a second surface, and a cushion arm, where, the first surface of the first adjustment member defines an opening mounted at least partially over the first tubular shaft of the truck support, the second surface of the second adjustment member seats against the guide surface of the truck support, where the predefined shape allows the first adjustment member to travel at least partially over the guide surface of the truck support and prevents the first surface of the first adjustment member from rotating relative the central axis, and the cushion arm extends away from the central axis and contacts a first lateral surface of the cushion;

a second adjustment member having a first surface, a second surface, and a cushion arm, where, the first surface of the second adjustment member defines an opening mounted at least partially over the second tubular shaft of the truck support, the second surface of the second adjustment member seats against the guide surface of the truck support, where the predefined shape allows the second adjustment member to travel at least partially over the guide surface of the truck support and prevents the first surface of the second adjustment member from rotating relative the central axis, and the cushion arm extends away from the central axis and contacts a second lateral surface of the cushion;

a first adjustment nut having a surface defining an internal thread that reversibly engages the threaded surface of the first tubular shaft of the truck support to move the cushion arm of the first adjustment member relative the first lateral surface of the cushion;

a second adjustment nut having a surface defining an internal thread that reversibly engages the threaded surface of the second tubular shaft of the truck support to move the cushion arm of the second adjustment member relative the second lateral surface of the cushion; and a wheel mounted on each of the first wheel shaft and the second wheel shaft.

10. A cushion for a truck assembly, comprising:

a front surface;

a rear surface opposite the front surface, where the front surface defines a concave segment and the rear surface defines a notch to receive a ridge of the truck assembly.

11. The cushion of claim 10, where the notch is 0.1 inch wide and 0.806 inch long.

* * * * *